United States Patent [19]

Schnyder

[11] Patent Number: 4,536,899

[45] Date of Patent: Aug. 27, 1985

[54] TOILET WITH FLUSHING DEVICE AND SELF-CLEANING SEAT

[76] Inventor: Erika Schnyder, Im Grubi, 9497 Triesenberg Fürstentum, Liechtenstein

[21] Appl. No.: 586,326

[22] Filed: Mar. 5, 1984

Related U.S. Application Data

[63] Continuation-in-part of Ser. No. 232,514, Feb. 9, 1981, abandoned.

[30] Foreign Application Priority Data

Feb. 28, 1980 [CH] Switzerland ..... 1583/80

[51] Int. Cl.[3] ..... A47K 13/30

[52] U.S. Cl. ..... 4/233; 4/237

[58] Field of Search ..... 4/222, 233, 237

[56] References Cited

U.S. PATENT DOCUMENTS 1,520,789 12/1924 Weill ..... 4/233

FOREIGN PATENT DOCUMENTS

| | | | |
|---|---|---|---|
| 52043 | 2/1911 | Austria | 4/233 |
| 214183 | 7/1909 | Fed. Rep. of Germany | 4/233 |
| 283470 | 9/1913 | Fed. Rep. of Germany | 4/233 |
| 1492467 | 1/1970 | Fed. Rep. of Germany | 4/233 |
| 83870 | 7/1935 | Switzerland | 4/233 |

*Primary Examiner*—Charles E. Phillips

[57] ABSTRACT

A toilet is constructed such that the toilet seat is rotatably arranged with respect to its circumferential direction. The toilet seat comprises a stationary part and a rotating part. The rotating part forms the seating surface of the toilet seat and is internally provided with a substantially conical circular track for engaging substantially conical bearing surfaces of rollers rotating about a substantially vertical axis and mounted in laterally translatable roller carrying members. The rotatable part of the toilet seat is driven by a round belt or cord cooperating with a pulley-like groove therein. A device for the liquid cleaning and disinfecting of the seat surface only extends over a segment of the toilet seat. During the seat cleaning operation the toilet seat is moved by the belt or cord. By means of the cleaning device there is accomplished cleaning of the toilet seat.

8 Claims, 10 Drawing Figures

TOILET WITH FLUSHING DEVICE AND SELF-CLEANING SEAT

This application is a continuation-in-part application of my U.S. application Ser. No. 06/232,514, filed Feb. 9, 1981, entitled "Toilet with Flushing Device and Self-cleaning Toilet Seat", now abandoned.

BACKGROUND OF THE INVENTION

The present invention relates to a new and improved construction of toilet having a flushing device and self-cleaning toilet seat, wherein there is provided a device for the liquid cleaning of the seat surface of the toilet seat and there is provided drive means for rotating the seat surface of the toilet seat which is mounted upon rollers.

There is already known to the art a toilet wherein the toilet seat is upwardly raised and displaced into a cleaning cabinet or box for the cleaning and disinfection of the toilet seat. This cabinet of course must be larger in size than the toilet seat itself. The cleaning device within such cabinet is complicated in construction and it is not possible to obtain in all instances a satisfactorily cleaned and dried seat surface. Also manipulations carried out at the toilet seat are cumbersome, particularly if under circumstances the seat surface is contaminated or soiled to a greater degree.

It is also known in the prior art, in particular from the German Patent No. 214,183, granted to Hermann Langner on July 10, 1908, to provide a rotatable toilet seat with belt drive means. In that disclosure, the rotatable seat member is provided with rollers mounted on horizontal radial axes and having grooved roll surfaces engaging a circular rib or track formed in the upper rim of the toilet fixture. Such an arrangement is subject to damage, vandalism and contamination by dirt. Furthermore the fixed arrangement of the rollers precludes any adaptation to manufacturing tolerances or inaccuracies. This situation is further aggravated by the formation of the track directly in the toilet fixture which, due to its size and its construction in vitreous enamel, is difficult to produce uniformly and accurately. The result is a high resistance to rotation. The track formed in the toilet fixture is difficult to clean and relatively expensive to produce. Also, the disclosed arrangement cannot be used with readily available conventional toilet fixtures. Finally, with this prior art arrangement the belt drive means is readily accessible from the outside, so that a danger of injury exists, especially when the toilet seat is used by children.

SUMMARY OF THE INVENTION

Therefore, with the foregoing in mind it is a primary object of the present invention to provide a new and improved construction of toilet having a flushing device and rotatable self-cleaning toilet seat which is not associated with the aforementioned drawbacks and limitations of the prior art proposals discussed above.

Another and more specific object of the present invention aims at providing a new and improved construction of a toilet provided with a flushing device and rotatable self-cleaning toilet seat, wherein the seat surface of the toilet seat is automatically cleaned during the toilet flushing operation and the construction of the equipment is simple and extremely reliable.

Yet a further significant object of the present invention aims at providing a new and improved construction of a toilet containing a flushing device and rotatable self-cleaning toilet seat wherein cleaning of the toilet seat can be accomplished in an extremely simple, reliable and efficient manner.

Now in order to implement these and still further objects of the invention, which will become more readily apparent as the description proceeds, the toilet of the present development is manifested by the features that the toilet seat comprises a stationary ring and a rotatable ring which is rotatably arranged with respect to its circumferential direction upon rollers disposed between a stationary ring and the rotatable ring forming the seat or seating surface of the toilet seat. These rollers are displaceably or translatably mounted on an inner surface of the stationary ring and are provided at their upper ends with substantially conical surfaces of rotation which engage a substantially conical bearing surface formed within the rotating ring. A device for the liquid cleaning of the seat surface extends over only a segment of the toilet seat.

A notable advantage of the invention particularly resides in the fact that the device intended for the cleaning of the toilet seat possesses small dimensions and in relation to the rotatable position of the toilet seat can function automatically without the need to raise the toilet seat. Additionally, there is realized efficient operation of the equipment and the same is less prone to malfunction and disturbances.

According to a further aspect of the invention there can be additionally provided a device for the sterilizing or disinfecting of the toilet seat surface.

BRIEF DESCRIPTION OF THE DRAWINGS

The invention will be better understood and objects other than those set forth above, will become apparent when consideration is given to the following detailed description thereof. Such description makes reference to the annexed drawings wherein through the various Figures of the drawings there have been generally used the same reference characters to denote the same or analogous components and wherein.

DETAILED DESCRIPTION OF THE PREFERRED EMBODIMENTS

Figure 1:
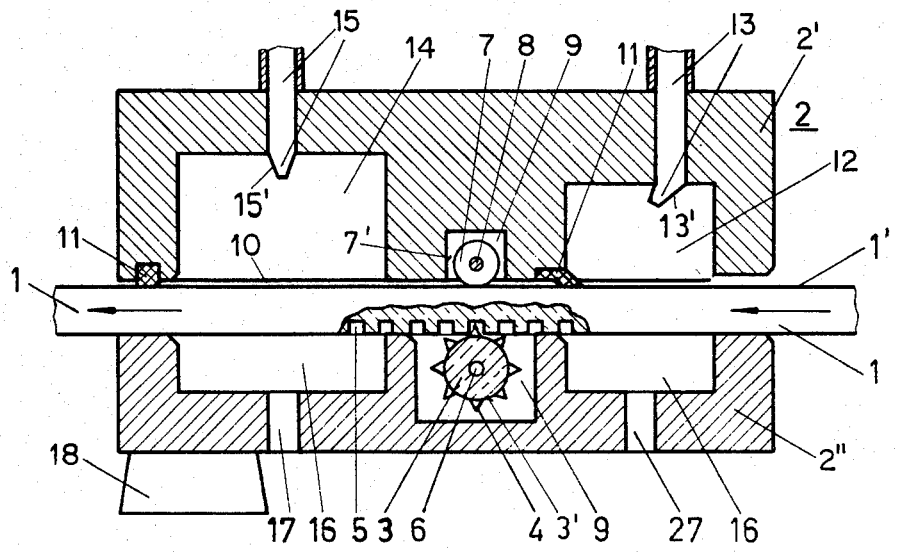
FIG. 1 is a partially vertical sectional view through an exemplary embodiment of device for the liquid cleaning and sterilization of the seat surface of a toilet seat and also illustrating part of the toilet seat itself.

Describing now the drawings, it is to be understood that throughout the various figures the same reference characters have been conveniently used to note the same or analogous components. Turning attention now to FIG. 1 there is shown a toilet seat 1 mounted in a substantially flat channel 10 which is formed between an upper portion or part 2' and a lower portion or part 2" of a transport and cleaning body or housing 2. Below the toilet seat 1 there is rotatably mounted a transport roll 3 or equivalent structure. This transport roll 3 is provided with teeth 4 and thus forms a gear-type element. In the lower surface of the toilet seat 1 there are formed recesses 5 which are complementary to and coact with the teeth 4 of the transport roll 3. A shaft 6 serves for mounting the transport roll 3. Above the toilet seat 1 there are arranged two support rolls or rollers 7 which are in contact with the seat surface 1' of the toilet seat 1, the surface of each support roll 7 being elastic. In fact, it is possible for the transport roll 3, the support roll 7, or both, to be provided with an elastic surface layer or a brush-like surface layer, as generally indicated and symbolized by reference characters 3' and 7', respectively. In FIG. 1 there has only been shown one of the support rolls 7. These support rolls 7 are attached to a common shaft 8. The transport roll 3 and the support rolls 7 are mounted in recesses 9 or equivalent structure of the body or housing 2. Extending within the flat channel 10 are rubber seals 11 which are attached at the upper portion 2' of the body or housing 2 and contact the toilet seat surface 1'. Within a chamber or space 12 serving for water cleaning of the toilet seat 1 there opens a channel 13 for the water infeed and equipped with a nozzle 13'. A chamber or space 14 for sterilizing the toilet seat 1 is connected with a channel 15 which likewise is provided with a nozzle 15' and serves for the infeed of a suitable sterilizing or disinfecting agent. Reference character 16 designates collecting chambers for the employed flushing water and sterilizing agent, respectively. The outflow channels from such collecting spaces or chambers 16 have been designated by reference characters 17 and 27. At the left-hand portion of FIG. 1 there has been shown part of a supply container 18 for the sterilizing agent.

Figure 2:
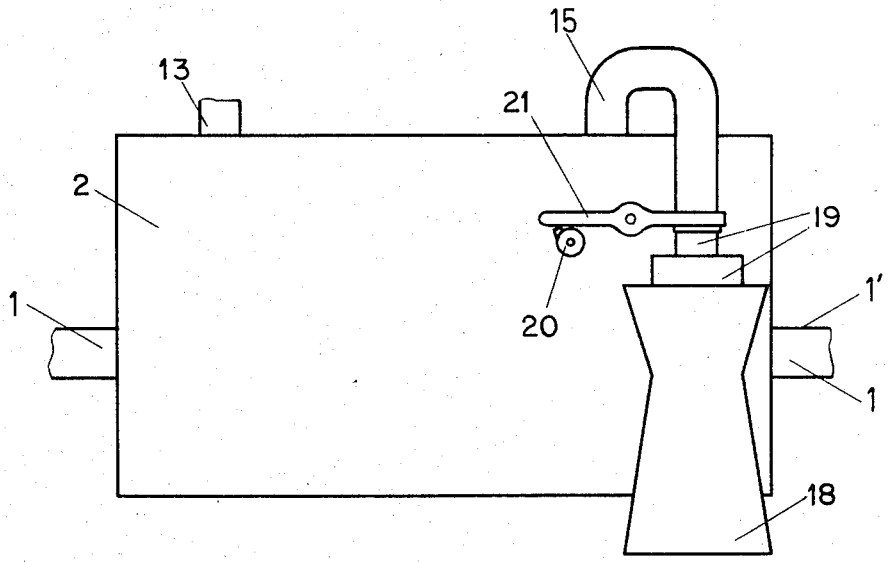
FIG. 2 is a rear view of the arrangement of FIG. 1.

In FIG. 2 the complete supply container 18 is visible. FIG. 2 shows the rear side of the device for the liquid cleaning and sterilization of the toilet seat 1. The supply container or reservoir 18 is provided in conventional manner with a suitable valve and an air pump generally designated by reference character 19. The control of the air pump 19 is accomplished by a cam 20 and a lever 21, although a different type of control can be employed.

Figure 3:
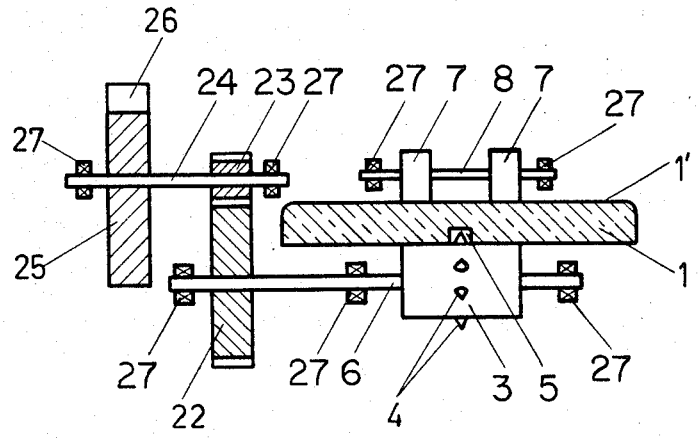
FIG. 3 is a simplified illustration of a drive mechanism for the exemplary embodiment of equipment shown in FIGS. 1 and 2.

In FIG. 3 there is shown a drive mechanism for the transport of the toilet seat 1 in its circumferential direction. The toilet seat 1 has been shown in cross-section. The teeth 4 of the transport roll 3 are in form-locking contact with the recesses 5 provided at the lower surface of the toilet seat 1. The shaft 6 of the transport roll 3 carries a larger size gear 22 which coacts with a smaller gear 23. The drive of the smaller gear 23 is accomplished by means of a drive gear 25 which with the smaller gear 23 possesses a common drive shaft 24. The support rolls 7, in the exemplary embodiment under discussion, ensure for the proper position of the toilet seat 1. The illustrated shafts 6, 8, 24 are arranged in suitable bearings 27 which are attached in the transport and cleaning body or housing 2.

Figure 4:
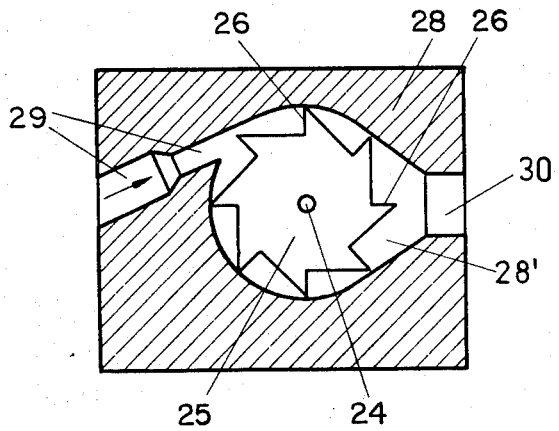
FIG. 4 illustrates a drive gear or drive structure for the drive mechanism used in the arrangement of FIG. 3.

FIG. 4 illustrates the drive gear 25 of FIG. 3 in side view. This drive gear 25, which may be a rudimentary or basic hydraulic turbine impeller by way of example, possesses eight work or function surfaces 26, one of which is also visible in the showing of FIG. 3. The drive gear or wheel 25 defining an impeller is mounted in a hollow space 28' of a body member or housing 28. For the infeed of the drive water or other suitable fluid medium there is provided a channel 29. A further channel 30 serves for the outfeed of the water.

Figure 5:
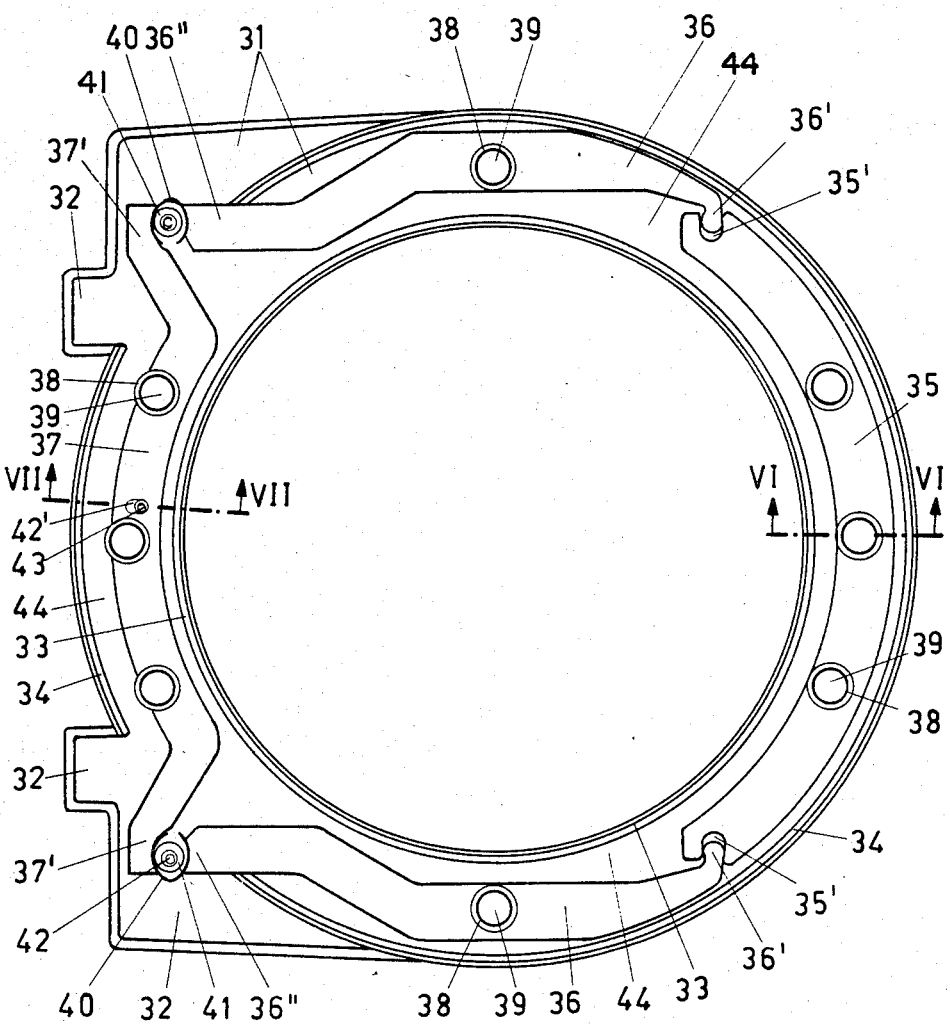
FIG. 5 is a schematic plan view of the hinge-mounted stationary ring, i.e. the lower non-rotatable portion of the toilet seat.

In the modified embodiment of FIG. 5 a stationary ring or base 31 is shown having a mounting portion 32. This stationary ring 31 forms the lower part of the toilet seat 1 and is not rotatable but can be pivoted upwards about a standard hinge arranged in the mounting portion 32. The hinge-mounted stationary ring 31 is provided with an inner annular side wall or raised portion 33 and an outer annular side wall or raised portion 34.

In the void or space 44 between these side walls 33 and 34 there are arranged a front roll carrying member 35, two lateral roll carrying members 36 and a rear roll carrying member 37. Recesses or sockets 35' are formed in the ends of the front roll carrying member 35 to engage the rounded forward ends 36' of the lateral roll carrying members 36. The opposite ends 36" of these roll carrying members 36 are provided with recesses or notches each engaging an elliptical or curved leaf spring 40 or equivalent structure. Both leaf springs 40 bear against recesses or notches provided in ends 37' of the rear roll carrying member 37 in order to support the latter. Spacer rings 41 are mounted on locating pins 42 inside the elliptical or curved leaf springs 40.

Rolls or rollers 38 rotating about substantially vertical axes are mounted by means of shafts 39 on the roll carrying members or roll carriers 35, 36 and 37. The rolls or rollers 38 are provided with substantially conical surfaces 38' at their upper regions and are maintained in an upper position on the shafts 39 by means of spiral springs 54, 54' not visible in FIG. 5 but shown in FIGS. 8 and 9.

Extended holes or slots 42' are formed in each roll carrying member 35, 36 and 37, as clearly shown for the roll carrying member 37 in FIG. 5. Screws 43 pass through these slots 42' to retain the roll carrying members 35, 36 and 37 on the stationary ring or base 31 with lateral side play. The extended or elongate form of the holes or slots 42' permit the roll carrying members 35, 36 and 37 and therefore also the rolls 38 to displace laterally. For reasons of representational clarity and as mentioned previously, only one extended hole or slot 42' is shown in FIG. 5 with its associated screw 43. Similar extended holes or slots 42' can also be formed in each of the other roll carrying members 35 and 36, preferably oriented with their long axis extending in the direction of motion of the rolls or rollers 38, i.e. substantially radially.

Figure 6:
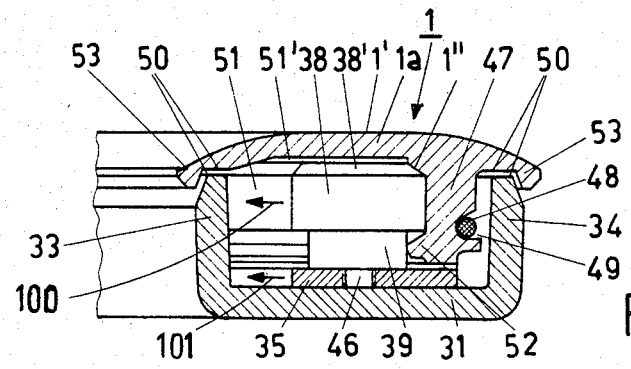
FIG. 6 shows a schematic cross-section taken along the line VI—VI of FIG. 5 and also showing the upper, rotatable portion or seating surface of the toilet seat.

FIG. 6 shows a schematic cross-section through the toilet seat of the invention taken at the line VI—VI of FIG. 5 and showing both the lower stationary ring or base 31 and the upper rotatable seat ring or seat portion 1*a* of the toilet seat 1.

Figure 8:
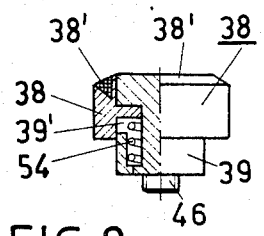
FIG. 8 shows a schematic partial section through an exemplary embodiment of the roller member of FIGS. 5 and 6.

A substantially conical bearing surface 1" formed at the junction of the main portion of the rotating ring or seat portion 1*a* and its outer reinforced ring 47 contacts the substantially conical surfaces 38' of the rolls 38 which, as is indicated in FIG. 8, are of a different material than the rest of the roll, preferably a rubber-like or elastomeric material. The shafts 39 of the rolls 38 are fastened to the related roll carrying member, such as the roll carrying member 35 by means of a screw 46 as shown in FIG. 6. The reinforced ring 47 is integrally formed on the rotatable ring 1*a* and is provided with a groove or depression 49 for a drive belt 48 as well as with an interior reinforcing flange 52. Opposing contact surfaces 50 of the upper rotatable seat portion 1*a* and the lower stationary ring or base 31 are held out of contact by the spring forces acting on the rolls 38, so that the stationary ring 31 and the rotatable ring or seat portion 1*a* are only in contact at the conical surfaces 38' of the rolls or rollers 38 and the conical surface 1'' of the rotatable ring or seat portion 1*a*. In this position the rotatable ring or seat portion 1*a* is free to rotate. When the rotatable ring or seat portion 1*a* is loaded from above, for instance by a seated occupant, the roll 38 shown in FIG. 6, together with the roll carrying member 35 is displaced to the left in the direction of the arrows 100 and 101, so that the contact surfaces 50 come into mutual contact and prevent the rotatable ring or seat portion 1*a* from rotating in this position. In the interior space or void 51 of the seat portion 1*a* there is a raised space or void 51'. The lower surface of the seat portion 1*a* defining the upper limit of this raised space or void 51' can either be higher than the height of the shaft 39 of the roll or roller 38 or can be designed to be supported by this shaft 39. The edge regions 53 of the rotatable ring or seat portion 1*a* are curved or arched downward to form a lip to protect the gap between the contact surfaces 50.

Figure 7:
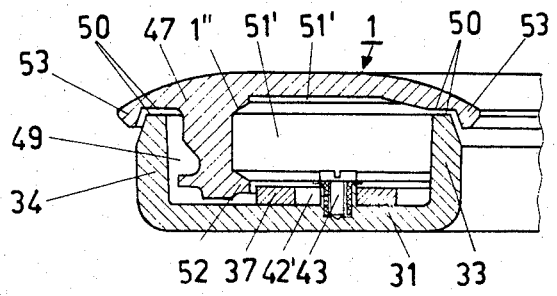
FIG. 7 shows a schematic cross-section along the line VII—VII of FIG. 5 also showing the rotatable portion or seating surface of the toilet seat.

FIG. 7 substantially corresponds to FIG. 6 except that the section is taken at line VII—VII of FIG. 5 and passes through the roll carrying member 37 at the location where the screw 43 engages the extended hole or slot 42'.

Figure 9:
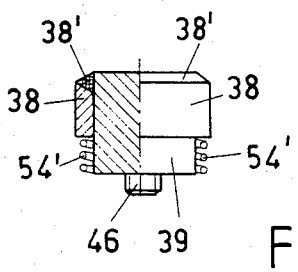
FIG. 9 shows a schematic partial cross-section through a further embodiment of the roller of FIGS. 5 and 6.

FIGS. 8 and 9 show two embodiments of the previously described roll 38. According to FIG. 8, a cylindrical spring 54 is arranged between the roll 38 and the shaft 39 in an interior space or void 39'. According to the modification of FIG. 9, a cylindrical spring 54' is arranged beneath the vertically movable roll 38.

Figure 10:
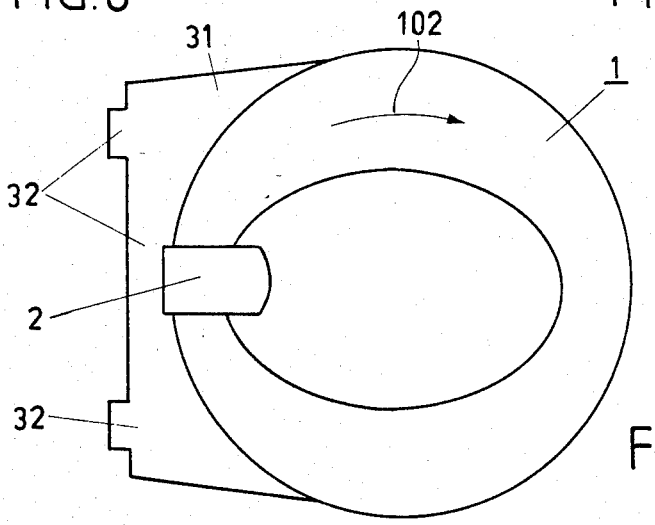
FIG. 10 shows a schematic plan view of a possible embodiment of the toilet seat and its associated cleaning and sterilizing means.

FIG. 10 shows a plan view of a toilet seat according to the invention having the aforedescribed rotatable ring or seat portion 1*a* and a device 2 for driving the seat portion into rotation in the direction of the arrow 102. This device 2 may be constituted, by means of, for instance, a hydraulic drive, such as a water turbine, acting on the drive belt 48 and a device for cleaning and optionally sterilizing the toilet seat by means of the elements previously described with reference to FIGS. 1 to 4.

As can be seen from FIG. 6, the rolls or rollers 38 prevent the rotating or rotatable ring or seat portion 1*a* of the toilet seat 1 from being lifted off the stationary ring or base 31. This can only be done after the curved leaf springs 40 and the spacer rings 41 have been removed, since only then can the roll carriers or roll carrying members 35, 36 and 37 with the rolls or rollers 38 be moved out of engagement with the reinforcing flange 52 without excessively loading the rotatable seat portion 1*a*.

As can be seen by comparing FIGS. 6 and 7, the rotatable ring or seat portion 1*a* has the same profile at the front and at the rear. It will be understood that an analogous, wider profile may be provided at intermediate regions. A difference between FIGS. 6 and 7 is that FIG. 7 shows a construction in which the rotatable ring or seat portion 1*a* is formed with a lower or shallower profile in the region of the mounting portion 32.

Having now had the benefit of the foregoing description the mode of operation of the inventive apparatus will be described and is as follows:

During flushing of the toilet a portion of the flushing water is used for three functions. The drive wheel or turbine impeller 25 is driven and thus the transport roll 3, so that the toilet seat 1 is placed into rotational movement. At the same time there is also rotated the cam 20 which is coupled with the transport roll 3, so that by means of the lever 21 there is pumped a certain quantity of air into the supply container or reservoir 18, which then expels an appropriate dosage, for instance 1.5 ml of the sterilizing agent from the supply container 18 into the channel 15. Further portions of the flushing water are conducted through the channel or duct 13 and the nozzle 13' into the chamber or space 12 for the water cleaning and through the channel 15 and the nozzle 15' into the chamber 14 serving for sterilization of the toilet seat 1, and in the channel 15 the water is admixed with the sterilizing agent.

As shown in FIG. 1 the toilet seat 1, with the first exemplary embodiment illustrated and under discussion, moves from the right towards the left in the direction of the arrows. The seat surface 1' which is to be cleaned and sterilized initially arrives at the chamber 12 for undergoing water cleaning. The nozzle 13' extends obliquely towards the left of such chamber 12 (FIG. 1), so that there is prevented outflow of the water towards the right. The used water flows laterally of the toilet seat 1 (i.e. according to the showing of FIG. 1 behind and forwardly of the toilet seat) into the collecting chamber 16 and the outflow channel 27. In the direction of the rotational movement of the toilet seat 1 the chamber 12 is bounded by the rubber seal means 11, so that the water cannot penetrate between the rolls 3 and 7. The rubber seal or seal means 11 simultaneously functions as a stripper or scraper, so that in the chamber 14 the toilet seat surface 1' can be sprayed with a highly concentrated sterilizing agent and thus faultlessly sterilized. Also this chamber 14 is bounded in the direction of the rotational movement of the toilet seat 1 by a further rubber seal 11, so that the toilet seat surface 1' is dry and clean externally of the transport and cleaning device 2.

Of course, the drive wheel or gear 25, the gears 22 and 23, the transport roll 3, the cam 20, the lever 21 and the air pump 19 are structurally designed such that the toilet seat 1 is transported throughout its entire periphery or circumference through the cleaning device 2, and during this movement both of the chambers or spaces 12 and 14 are supplied with appropriate liquids.

As indicated above, power for driving the toilet seat into rotation may be obtained from a water wheel or hydraulic motor or turbine of known type engaging the flow of flushing water or from other known motor means, such as an electric motor. Known means of power transmission, such as gear drives, belt drives or shaft drives, transmit the power to a standard transport roll engaging the drive belt 48 of the embodiments of FIGS. 5 to 10, such as the transport roll 3 of FIG. 1. The drive belt 48 drivingly engages groove 49 provided in the reinforced ring 47 of the rotatable seat portion 1*a* to impart rotational motion thereto. Since the rotatable seat portion 1*a* is not loaded by a seated occupant during the flushing operation, the opposed contact surfaces 50 are in their separated position and the rotatable seat portion 1*a* bears on the conical surfaces or rollers 38' of the rolls 38 with its conical surface 1''. The rolls 38 are free to rotate about substantially vertical axes and act to support and guide the seat portion 1*a* in its rotation. The extended holes or slots 42' permit lateral displacement of the roll carrying members 35 and with them the rolls or rollers 38 in order to accommodate minor irregularities or inaccuracies of the conical surface 1''.

Of course, the invention is not limited to the embodiments shown in the drawings by way of example. Thus, for instance, the disclosed and illustrated constructions can be designed as a constructional unit along with the flushing water reservoir. It is possible to employ a different known dosing device, for instance a water driven piston pump.

The equipment also can operate with a single cleaning chamber. This single cleaning stage or also the channel 13 for the water infeed, in the exemplary embodiment of FIG. 1, can have infed thereto for instance any suitable commercially available, liquid household cleaning agent.

For this purpose there is suitable for instance a pump working according to the ejector principle.

The apparatus of the invention can be arranged to be fixed or tiltable.

Equally the mode of operation can be different than that described by way of example. With lesser pressure of the flushing water the cleaning can be accomplished first following the flushing operation. In this case there is used for the drive and the cleaning part of the water flowing in the flushing water reservoir.

In place of an exchangeable of refillable supply container 18 there also could be used a known spray can.

While there are shown and described present preferred embodiments of the invention, it is to be distinctly understood that the invention is not limited thereto, but may be otherwise variously embodied and practiced withing the scope of the following claims.

Accordingly, what I claim is:

1. A toilet, comprising:

a toilet seat comprising a stationary ring defining a toilet seat base and a rotatable ring defining a seat surface of the toilet seat;

said stationary ring having an outer circumference;

rollers arranged between said stationary ring and said rotatable ring and having upper portions;

said rollers conjointly defining a substantially circular path of travel for said rotatable ring in relation to said stationary ring and which path of travel extends substantially concentrically with respect to said outer circumference;

said rotatable ring being rotatably arranged upon said rollers for moving along said path of travel;

said stationary ring having an inner surface;

means for mounting each roller of said rollers translatably in a direction extending substantially transverse to said path of travel on said inner surface of the stationary ring and in a direction substantially normal to said inner surface;

said rotatable ring being provided with a substantially conical bearing surface;

said rollers being provided at said upper portions thereof with surfaces of revolution which are substantially conical; and said substantially conical surfaces of revolution engaging in substantially straight-line contact said substantially conical bearing surface formed at said rotatable ring.

2. The toilet as defined in claim 1, further including:

a device for the liquid cleaning of the seat surface of the toilet seat surface; and said cleaning device extending over only a segment of the toilet seat.

3. The toilet as defined in claim 1, wherein:

said rotatable ring has an outer reinforced ring at which said substantially conical bearing surface is provided;

each of said rollers is provided with a shaft; and each of said rollers together with its shaft possessing a length which is greater than the spacing of said substantially conical bearing surface provided at said outer reinforced ring of the rotatable ring from attachment locations of the shafts of the rollers to said means for translatably mounting each roller.

4. The toilet as defined in claim 3, wherein:

said rotatable ring is structured to define an inner space at said outer reinforced ring which is adjacent to the substantially conical bearing surface and which is raised with respect to said substantially conical bearing surface.

5. A toilet comprising:

a toilet seat comprising a stationary ring defining a toilet seat base and a rotatable ring defining a seat surface of the toilet seat;

said stationary ring having an outer circumference;

rollers arranged between said stationary ring and said rotatable ring and having upper portions;

said rollers conjointly defining a substantially circular path of travel for said rotatable ring in relation to said stationary ring and which path of travel extends substantially concentrically with respect to said outer circumference;

said rotatable ring being rotatably arranged upon said rollers for moving along said path of travel;

said stationary ring having an inner surface;

means for mounting each roller of said rollers translatably in respective directions extending substantially transverse to said path of travel on said inner surface of the stationary ring;

said rotatable ring being provided with a substantially conical bearing surface;

said rollers being provided at said upper portions thereof with surfaces of revolution which are substantially conical;

said substantially conical surfaces of revolution engaging in substantially straight-line contact said substantially conical bearing surface formed at said rotatable ring;

said rollers being arranged to define axes of rotation extending substantially perpendicular to said stationary ring;

each of said rollers being provided with a shaft;

a respective pressure-loaded spring means provided for each of said rollers; and said rollers being displaceable in the direction of their related shaft in the direction of the stationary ring and against the force of a related one of said pressure-loaded spring means.

6. A toilet comprising:

a toilet seat comprising a stationary ring defining a toilet seat base and a rotatable ring defining a seat surface of the toilet seat;

said stationary ring having an outer circumference;

rollers arranged between said stationary ring and said rotatable ring and having upper portions;

said rollers conjointly defining a substantially circular path of travel for said rotatable ring in relation to said stationary ring and which path of travel extends substantially concentrically with respect to said outer circumference;

said rotatable ring being rotatably arranged upon said rollers for moving along said path of travel;

said stationary ring having an inner surface;

means for mounting each roller of said rollers translatably in respective directions extending substantially transverse to said path of travel on said inner surface of the stationary ring;

said rotatable ring being provided with a substantially conical bearing surface;

said rollers being provided at said upper portions thereof with surfaces of revolution which are substantially conical;

said substantially conical surfaces of revolution engaging in substantially straight-line contact said substantially conical bearing surface formed at said rotatable ring;

each of said rollers having a shaft;

said means for translatably mounting each roller comprising roll carrying members provided for said rollers; and each of said rollers conjointly with its shaft being secured in a related one of said roll carrying members to define a respective axis of rotation extending substantially perpendicular thereto.

7. The toilet as defined in claim 3, wherein:

each of said roll carrying members has opposed ends;

one of said opposed ends of each roll carrying member being provided with a recess and the other opposed end with engaging means;

said roll carrying members being conjointly coupled with one another by means of said recesses and engaging means;

said stationary ring having an outer substantially ring-shaped wall; and at least one pressure-loaded spring cooperating with said roll carrying members for displacing said roll carrying members outwardly towards the outer substantially ring-shaped wall of the stationary ring.

8. The toilet as defined in claim 3, wherein:

each of said roll carrying members is provided with at least one elongated hole;

a respective screw member extending through each said elongated hole and serving for retaining each said roll carrying member with play; and each said hole having a direction of extent oriented in accordance with a desired direction of movement of the related roll carrying member and the rollers carried thereby.

* * * * *